United States Patent [19]

Hart

[11] 4,052,852

[45] Oct. 11, 1977

[54] CONSTANT PRESSURE SEALED FLUID STORAGE TANK FOR HYDRAULIC SYSTEMS

[75] Inventor: Cullen P. Hart, Peoria, Ill.

[73] Assignee: Caterpillar Tractor Co., Peoria, Ill.

[21] Appl. No.: 744,073

[22] Filed: Nov. 22, 1976

[51] Int. Cl.[2] ..... F15B 1/06

[52] U.S. Cl. ..... 60/478; 138/30

[58] Field of Search ..... 60/478, 477, 454, 453, 60/378, 371, 415, 418; 138/30

[56] References Cited

U.S. PATENT DOCUMENTS

| | | | |
|---|---|---|---|
| 2,337,771 | 12/1943 | Roberts | 138/30 |
| 2,492,014 | 12/1949 | Spalding et al. | 138/30 X |
| 2,597,050 | 5/1952 | Audemar | 60/536 |

*Primary Examiner*—Edgar W. Geoghegan

*Attorney, Agent, or Firm*—Phillips, Moore, Weissenberger, Lempio & Majestic

[57] ABSTRACT

A closed rigid tank stores oil or other liquid for use in operating hydraulic jacks or other fluid-driven devices. A flexible bladder within the tank is coupled to a source of compressed air and to an air pressure regulator in order to maintain a constant positive pressure in the tank as the bladder expands and contracts in response to the withdrawal and return of oil. The sealed regulated pressure tank may be smaller, lighter and less costly than the tank structures heretofore used in hydraulic systems and the construction is more adaptable to variations in tank shape and location relative to other system components. Fluid lines which connect the tank and fluid pump may be smaller and the total volume of oil required for the hydraulic system may be reduced.

10 Claims, 2 Drawing Figures

CONSTANT PRESSURE SEALED FLUID STORAGE TANK FOR HYDRAULIC SYSTEMS

BACKGROUND OF THE INVENTION

This invention relates to hydraulic systems in which pressurized fluid is used for operating hydraulic jacks or other fluid-driven mechanisms and more particularly to the hydraulic tanks which contain the operating fluid supply for such systems.

Many hydraulic systems have components which require different amounts of operating fluid at different stages of operation. On earthmoving vehicles for example, various load-manipulating elements may be operated by fluid cylinders or jacks of the form having a piston which is extended within a cylinder by oil pressure. As the jack extends, the amount of oil in the jack increases and oil is released as the jack contracts. Although in most cases not all the components of a given system are extended to their maximum oil-containing volume at the same time, this can occur on occasion and thus the volume of oil available to the system should be at least equal to the maximum oil-containing capacity of all such displacement-type components. In practice it may be desirable that somewhat more oil be available to compensate for possible leakage and to compensate for the effects of temperature changes in varying the volume of a given amount of oil.

To meet these requirements, hydraulic systems are customarily provided with a storage means or hydraulic tank from which oil is withdrawn as needed when the displacement of components of the system increase and to which oil is returned as the displacement of such components is decreased. In most instances oil is withdrawn from the hydraulic tank by a pump, which pressurizes the fluid, and is later returned to the tank through drain lines.

One form of hydraulic tank simply has an oil outlet at or near the lower portion of the tank while the upper portion of the tank is vented to the atmosphere. Such tanks are subject to several serious problems and impose design restrictions on the associated hydraulic system which may not necessarily be desirable. The intermixing of air and oil which can occur in such a tank detracts from the working efficiency of the associated system, may cause rapid deterioration of the oil and imposes requirements for baffles and diffusers and the like in oil return lines. In most cases such a tank must necessarily be situated above the pump to which it is connected. In instances where the tank may not always be maintained in a precisely horizontal position, such as on an earthworking vehicle. restrictions on the shape of the tank are present as it must be made sufficiently high in relation to its width to assure that the oil in the tank remains adjacent the outlet when the tank is tilted. Such a tank must be large and costly in order to retain a volume of oil exceeding the maximum requirements of the associated hydraulic system and in order to deliver and receive oil at sufficiently rapid rates to accommodate to the needs of the system. Cooling problems are aggravated in that oil is not usually in contact with all of the inner surface of the tank. Further, such a tank is not ideally adapted to the use of a screen or filter between the tank and the pump which draws fluid from the tank. Sediment tends to collect on the bottom of the tank and since the outlet is necessarily at the bottom, a screen or filter in the oil withdrawal line tends to clog very rapidly. The pressure tending to force oil through such a filter is relatively low.

Some of the foregoing problems, but by no means all, may be alleviated if the tank is sealed as is a common practice at this time. Using conventional constructions, this requires a relatively large-sized tank to provide a sufficient air volume to avoid excessive pressure changes when substantial amounts of oil are withdrawn or returned to the tank. The conventional sealed tank is still subject to the configuration and location restrictions, aeration complications and many of the other problems discussed above.

To alleviate still more of these problems hydraulic tanks have heretofore been constructed in which the air volume within the tank is completely sealed from the oil volume by flexible fluid-tight means which can expand and contract as oil is withdrawn and returned. Copending application Ser. No. 443,303 of Ralph W. Matthews filed Feb. 19, 1974 now U.S. Pat. No. 3,935,882 and entitled "Hydraulic Tank Reservoir Pressure and Vacuum Stabilizer System" discloses such a system. Problems arising from the intermixing of air and oil are greatly reduced but may not be wholly eliminated. Aeration can still occur from leakage past seals and joints in the tank or associated hydraulic system particularly when the internal fluid pressure drops slightly below atmospheric due to small negative pressures arising from fluid flows.

In part to alleviate the last-mentioned problem and also to free the tank configuration from restrictions on the location of the oil outlet, some prior tank constructions have employed an expandable and contractable internal bladder to contain the air volume with the bladder being charged with compressed air. While these designs alleviate still more of the problems discussed above, prior tanks of this kind are subject to a further problem in that the tank pressure varies substantially. As oil or the like is withdrawn, the bladder expands and therefore the pressure within the tank including the oil pressure decreases. As oil is returned the bladder contracts and tank pressure necessarily rises. This variable base pressure can have adverse effects on the operation of the pump and on the hydraulic jacks and other components of the hydraulic system. While pressure fluctuation can be counteracted to a limited extent by increasing the size of the tank, this in itself can be a significant disadvantage as discussed above.

SUMMARY OF THE INVENTION

The present invention is a hydraulic tank construction which eliminates or reduces each of the problems discussed above. The invention includes a rigid sealed tank with one or more ports for receiving and supplying oil or the like to an associated hydraulic system. An expandable and contractable flexible bladder is situated within the tank and communicated with a second port. A source of compressed air or other pressurized gas including a pressure-regulator is communicated with the second port. Owing to the pressure-regulation, the internal pressure within the tank remains substantially constant as oil is withdrawn and the bladder expands and as oil is returned and the bladder contracts.

Relative to prior systems of comparable capacity, the tank of the present invention may be small, light and inexpensive and is comparatively free of restrictions as to shape and location. Since the internal oil is pressurized, outlet and inlet openings may be situated at any location most suited to the associated hydraulic circuit.

The outlet line which connects to the pump and the pump itself may be relatively small since tank pressurization aids fluid flow. For the same reason the tank may be formed with any shape which is best suited to the particular usage and may be situated below the pump if that is most convenient. Oil cooling is enhanced since oil contacts all interior surfaces of the tank and aeration problems are largely eliminated not only because the oil is isolated from the pressurized air but also because the positive pressure throughout all portions of the system inhibits inward suction of air through any faulty joints or seals. Since the oil outlet need not be at the bottom of the tank, a screen or filter may be situated between the tank and the pump without being particularly prone to clogging and in any case, the elevated pressure aids oil flow through the filter.

Accordingly, it is the object of this invention to provide a compact, light and inexpensive fluid storage means for a hydraulic system which is adaptable to being formed with any of various configurations and which may be situated in any suitable locations relative to associated fluid components.

It is still another object of the invention to provide a fluid storage means in a hydraulic system which reduces aeration problems, reduces the overall volume of operating fluid required for the system and enables a reduction in the size of fluid lines between the tank and pumping means of the system.

The invention together with further objects and advantages thereof will best be understood by reference to the following description of a preferred embodiment, taken in conjunction with the accompanying drawing.

DESCRIPTION OF THE PREFERRED EMBODIMENT

Figure 2:
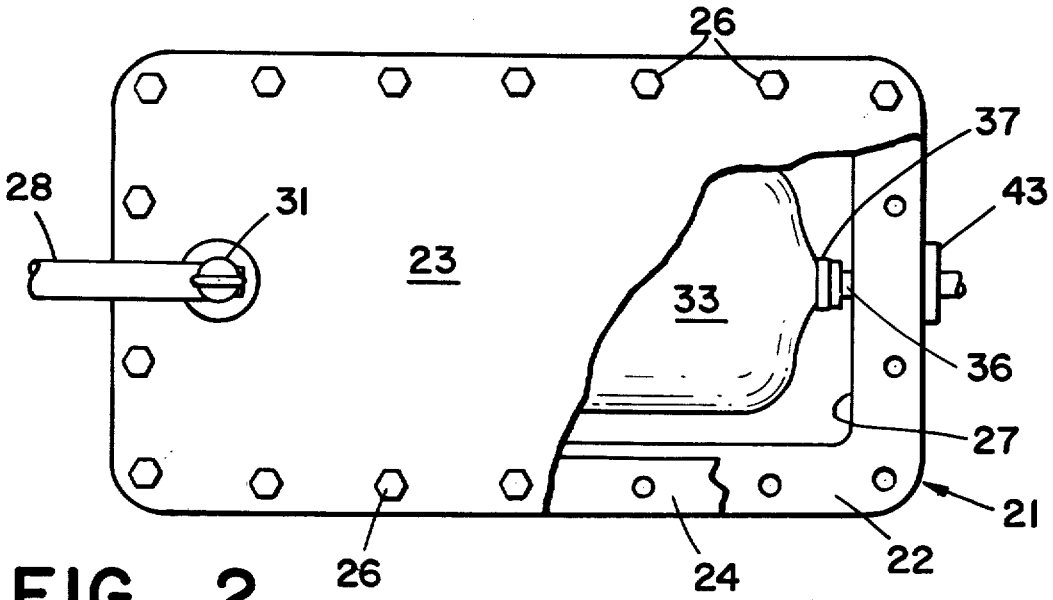
FIG. 2 is a partially broken-out top view of the fluid tank of FIG. 1.
Figure 1:
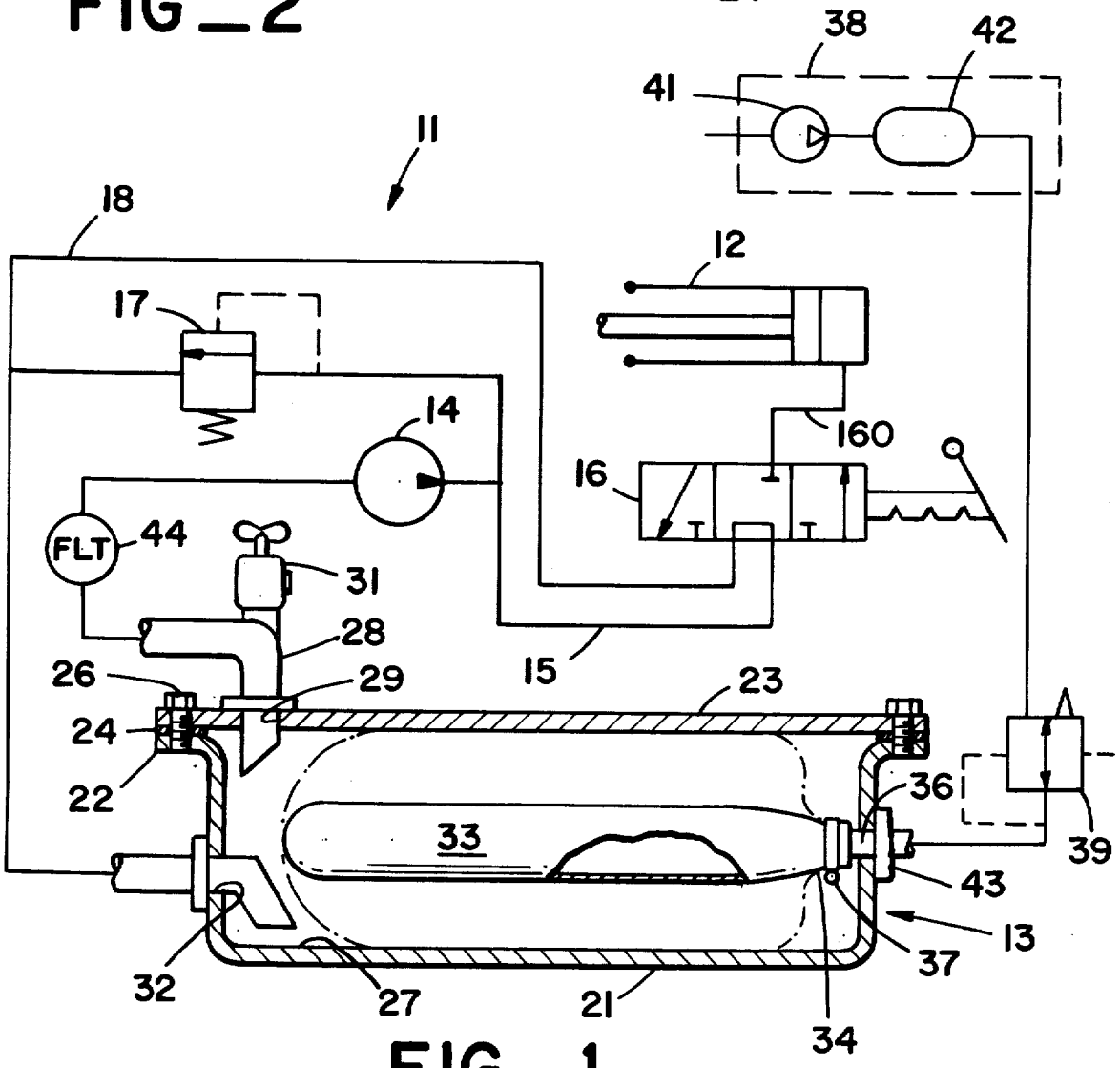
FIG. 1 is an elevation section view of a hydraulic system fluid storage tank with associated components of the system being shown in schematic form.

Referring now to the drawing and more particularly to FIG. 1 thereof, basic components of a hydraulic system 11 as employed on an earthmoving vehicle, for example, may include one or more hydraulic jacks or fluid cylinders 12 operated by oil or other liquid drawn from a storage means 13 by a pump 14 with the fluid which is discharged by the jacks or the like being returned to the storage means. Typically the outlet conduit 15 from pump 14 is coupled to the inlet of one or more jack control valves 16. If the jack 12 is of the single-acting form as shown in FIG. 1 for purposes of example, control valve 16 may have an outlet 160 coupled to one end of the jack. A relief valve 17 has an inlet connected to the outlet of pump 14 and an outlet connected to a drain or return line 18 to storage means 13 in order to maintain a constant system operating pressure at the inlet to control valve 16.

Control valve 16 may typically be of the three-position manually operated form having a center or Hold position at which jack 12 is isolated from the operating fluid line 15 by control valve 16. At the center position of control valve 16, the valve communicates the pressurized fluid supply line 15 with the return line 18 to tank 13 while sealing off jack 12 causing the jack to be immobilized. When the control valve 16 is shifted to a second position, pressurized oil from line 15 is communicated to the head end of the jack 12 which then extends in response to the fluid pressure. At the third position of control valve 16, the head end of the jack is communicated with the return line 18, thereby causing the jack to contract in response to external load forces acting on the jack. Accordingly, by manually manipulating control valve 16, an operator may selectively cause the jack 12 to extend, contract or be immobile.

The hydraulic system 11 as described to this point is a typical example of the fluid circuits employed to operate and control linear fluid motors in various forms of apparatus such as in earthmoving vehicles for one example. Although a single control valve 16 and hydraulic jack 12 has been described, in practice there are often several such mechanisms on a particular vehicle, all of which are usually operated with fluid drawn from a single storage tank 13 by a single pump 14. The high-pressure oil line 15 from pump 14 may be extended as necessary to connect with other such control valves and jacks as might be required in the particular usage.

Considering now a representative construction for the hydraulic tank 13 and associated mechanisms, it is a characteristic of the present invention that there are less restrictions on the configuration and location of the tank 13 than has heretofore been the case in most hydraulic systems. The tank 13 in this example is shown as being of a relatively shallow rectangular configuration and as being situated below the pump 14 which draws fluid from the tank, this being a configuration and placement which is often unsuited to more conventional hydraulic tank constructions for reasons hereinbefore described. In this example, the tank 13 has a rectangular bottom pan 21 with a flange 22 at the upper portion against which a flat rectangular cover plate 23 is disposed. A resilient seal 24 may be disposed between the edge of cover plate 23 and flange 22 and bolts 26 may extend through the edge of the cover plate, the seal and flange 22 to secure the members together in a fluid-tight relationship thereby defining a fluid-tight interior chamber 27 within the tank.

Because the oil volume within tank 13 is sealed from contact with air and is maintained under pressure by means to be hereinafter described, it is not necessary that the outlet through which oil is withdrawn be located at the bottom of the tank but instead the outlet conduit 28 to pump 14 may be situated where it is most convenient for other purposes and in the present example enters the tank through an outlet port 29 situated near one end of cover plate 23. To enable the purging of any trapped air from the oil in the system when tank 13 is first filled, a normally closed manually operable bleed valve 31 may be coupled to outlet line 28 immediately above tank 13. While line 28 may be branched if desired to enable the first port 29 to serve both as the oil outlet and oil return line, in the present example an additional port 32 is provided in the end of pan 21 below port 29 to receive return line 18. The areas at which both oil lines 18 and 28 pass through the wall of the tank 13 are sealed as by welding or other suitable means.

In order to pressurize the oil within tank 13, an expandable and collapsible closed flexible bladder 33 is situated within chamber 27 of the tank. Bladder 33 in the collapsed condition may have a shape conforming substantially to that of the chamber 27 although in many instances, including this example, the bladder may be somewhat shorter than the chamber so that in the expanded state it does not interfere with the withdrawal and release of oil at lines 28 and 18 respectively. Bladder 33 has a neck 34 fitted onto an air pipe 36 which transpierces the end of tank 13 opposite from the oil outlet and return lines. A suitable annular clamp 37 secures neck 34 of the bladder to air pipe 36 in fluid-tight relationship so that air may be admitted to the bladder and released from the bladder while maintaining the oil volume in the tank isolated from the air volume therein.

To maintain a constant positive fluid pressure within the tank 13 as oil is variously withdrawn and returned and as the bladder 33 therefore expands or contracts, air pipe 36 is connected with a source of compressed air 38 through a pressure-regulator valve 39 of the form having an outlet side at which a constant predetermined pressure is maintained. Compressed air source 38 may be of any suitable form such as the air supply system for the brakes of a vehicle or the output of a turbo-charger and typically includes, among other components, a compressor pump 41 charging a compressed air reservoir 42. Although the pressure-regulator valve 39 may, if desired, be an element of the compressed air source 38 located apart from tank 13, in this example it is situated within a housing 43 secured to the side of tank 13 at the location where the air pipe 36 from the pressure regulator valve enters the tank. This eliminates any pressure variations which might otherwise arise from pressure differentials in the line connecting the regulator valve and the tank.

In operation, the region of tank chamber 27 external to bladder 33 is continuously and fully filled with oil or other operating fluid for the system while the region of the chamber within bladder 33 is charged with compressed air at a constant predetermined pressure fixed by the pressure-regulator valve 39. Aside from thermal expansion and contraction effects and possible leakage, the total volume of oil in the tank 13 and associated hydraulic system remains constant. However, the oil volume within tank 13 itself may vary substantially in the course of operations as oil is transferred from the tank to various displacement-type components of the system such as hydraulic jack 12 and then subsequently returned.

As the volume of oil within tank 13 changes in this manner, bladder 33 expands or contracts as necessary to maintain the oil in the tank under pressure. Moreover, this internal fluid pressure within tank 13 remains constant rather than decreasing as the bladder expands and increasing as the bladder contracts inasmuch as pressure-regulating valve 39 transmits additional air to the bladder or releases air from the bladder as required to maintain the constant predetermined positive pressure. In order to perform this function, the fully expanded volume of bladder 33 should be at least equal to the volume of oil required to fill all displacement-type components of the system such as hydraulic jack 12 in their most extended state and preferably with an additional allowance for normal system leakage and system volume change due to thermal expansion effects. Similarly, it is desirable that the pressure-regulator valve 39 have sufficient flow capacity to supply or release air from bladder 33 at a volumetric rate equal to that at which oil is withdrawn and returned to the tank.

The above-described hydraulic tank 13 and associated pressure-control mechanisms exhibit several advantages relative to prior devices of this general kind. Since oil within the tank 13 is maintained at a constant elevated pressure, the oil outlet line 28 may be located at the top of the tank or any place else where it may be convenient. Owing to the constant pressurization of the tank 13, the oil pump 14 may, if desired, be situated above the tank and the line 28 which connects the pump to the tank may be smaller in diameter since the pressurization within the tank tends to aid the pumping action. Oil in the tank is fully isolated from air and, in addition, the positive pressure throughout all portions of the system including outlet line 28 and the drain or return line 32 tends to prevent air from being sucked into the oil through a faulty joint, seal or other leak. There are no particular restrictions on the shape of the tank 13 and oil cooling is highly efficient as the oil contacts all of the interior surface of the tank chamber 27. With the oil outlet 29 at the upper portion of the tank, a screen or filter 44 may be placed between the tank and oil pump 14 without severe problems from clogging by accumulated sediment. No baffles or return line diffusers are necessarily needed inside the tank which is therefore simpler and easier to clean. A significant consequence of the constant internal pressurization of the tank together with certain of the other characteristics discussed above such as a reduced-diameter outlet line 28 is that for a given hydraulic system 11, the tank 13 may be smaller, lighter and less costly and a lesser volume of oil is required within the system as a whole.

While the invention has been disclosed with respect to a specific example, it will be apparent that many modifications are possible and it is not intended to limit the invention except as defined in the following claims.

The embodiments of the invention in which an exclusive property or privilege is claimed are defined as follows:

1. An operating fluid storage fo a hydraulic system having variable operating fluid requirements comprising:

a rigid closed tank defining an interior chamber for storing said operating fluid and having first port means for receiving and releasing said fluid and having second port means for connection to a source of pressurized gas, an expandable and contractable fluid-tight bladder disposed within said chamber of said tank and being communicated with said second port means to receive and release said gas as operating fluid is withdrawn and received at said tank, and means for maintaining a predetermined substantially constant gas pressure within said bladder as the volume of operating fluid in said tank and the volume of said bladder undergoes changes.

2. Apparatus as defined in claim 1 wherein said means for maintaining a predetermined substantially constant gas pressure within said bladder comprises a source of compressed air coupled to said second port means through a pressure-regulator valve.

3. Apparatus as defined in claim 2 wherein said pressure-regulator valve has sufficient air flow capacity to admit and release gas at said second port means at a volumetric rate at least equal to the maximum volumetric rate at which said operating fluid is admitted and released from said tank at said first port means.

4. Apparatus as defined in claim 1 wherein said first port means is coupled to at least one fluid-operated hydraulic jack through a pump whereby said tank supplies operating fluid for said jack and receives operating fluid discharged by said jack.

5. Apparatus as defined in claim 4 wherein the volume of said bladder in the fully expanded state thereof is at least equal to the maximum volume of said operating fluid which may be withdrawn from said tank in the course of operation of said hydraulic jack.

6. Apparatus as defined in claim 4 wherein said pump is situated above said tank.

7. Apparatus as defined in claim 1 further comprising a normally closed air bleed valve communicated with the uppermost region of said chamber.

8. Apparatus as defined in claim 7 wherein said first port means is situated at the top of said tank and wherein said bleed valve is situated above said first port means and communicated therewith.

9. Apparatus as defined in claim 1 wherein said bladder has a configuration in the fully expanded state conforming substantially to that of said chamber within said tank but being shorter in one dimension than said chamber whereby one portion of said chamber is unoccupied by said bladder when in the fully expanded state, said first port means being situated in said one portion of said chamber.

10. Apparatus as defined in claim 1 wherein said first port means is situated above the bottom of said tank, further comprising a pump connected to said first port means, and filter means disposed in the flow path between said tank and said pump.

* * * * *